US008030573B2

(12) United States Patent
Chirumbolo

(10) Patent No.: US 8,030,573 B2
(45) Date of Patent: Oct. 4, 2011

(54) CABLE-CLAMPING DEVICE

(75) Inventor: Dino Chirumbolo, Settimo Torinese (IT)

(73) Assignee: ITW Industrial Components S.R.L. Con Unico Socio, Milan (IT)

( * ) Notice: Subject to any disclaimer, the term of this patent is extended or adjusted under 35 U.S.C. 154(b) by 484 days.

(21) Appl. No.: 12/298,090

(22) PCT Filed: Jul. 6, 2007

(86) PCT No.: PCT/IB2007/001868

§ 371 (c)(1),
(2), (4) Date: Oct. 22, 2008

(87) PCT Pub. No.: WO2008/004094

PCT Pub. Date: Jan. 10, 2008

(65) Prior Publication Data

US 2009/0101389 A1 Apr. 23, 2009

(30) Foreign Application Priority Data

Jul. 6, 2006 (IT) ..... TO2006A0498

(51) Int. Cl.
*H01B 7/00* (2006.01)

(52) U.S. Cl. ..... 174/135; 174/93; 174/84 R; 439/470

(58) Field of Classification Search ..... 174/135, 174/93, 84 R, 168; 439/470, 471
See application file for complete search history.

(56) References Cited

U.S. PATENT DOCUMENTS 3,483,309 A * 12/1969 Garcia et al. ..... 174/668
4,407,471 A * 10/1983 Wilmsmann et al. ..... 248/63
5,998,373 A * 12/1999 Hillman et al. ..... 514/20.1
6,375,439 B1 4/2002 Missio
7,772,498 B2 * 8/2010 Kobayashi et al. ..... 174/135

FOREIGN PATENT DOCUMENTS

| | | | |
|---|---|---|---|
| DE | 20216030 | U | 2/2003 |
| EP | 0378057 | A2 | 7/1990 |
| EP | 0793068 | A1 | 9/1997 |
| EP | 1075056 | A2 | 2/2001 |
| EP | 1257011 | A2 | 11/2002 |

OTHER PUBLICATIONS

International Search Report for PCT/IB2007/001868 dated Mar. 4, 2008.

* cited by examiner

*Primary Examiner* — Dhirubhai R Patel
(74) *Attorney, Agent, or Firm* — Lowe Hauptman Ham & Berner, LLP

(57) ABSTRACT

A cable-clamping device, in particular for household appliances, including a base having a through seat for accommodating at least one electrical cable; and a clamping element progressively insertable in the seat in a first direction transversal to the seat and defined in use by an axis laying on a longitudinal symmetry plane of the clamping element, for clamping in use the cables against a bottom wall of the seat; the clamping element being delimited between a first and a second ends of the clamping element by a first and a second lateral flanks of the clamping element essentially parallel to the symmetry plane and by an upper face essentially parallel to the lateral flanks, the first and the second ends being provided with a coupling device to the base comprising a snapping retaining device made at the second end and an insertion seat for at least one removable tightening element.

12 Claims, 2 Drawing Sheets

CABLE-CLAMPING DEVICE

RELATED APPLICATIONS

The present application is based on International Application Number PCT/IB2007/001868 filed Jul. 6, 2007, and claims priority from Italian Application Number TO2006A000498 filed Jul. 6, 2006, the disclosures of which are hereby incorporated by reference herein in their entirety.

TECHNICAL FIELD

The present invention relates to a cable-clamping device, specifically adapted to fasten electrical cable bundles of various dimensions.

BACKGROUND ART

As known, electrical standards require operating machines, specifically household appliances such as refrigerators, washing machines etc., to be provided with cable-clamping devices to prevent the main electrical power cables and/or those of some services, to be accidentally disconnected from the corresponding terminal boards by tearing, e.g. due to a strain accidentally produced on the cables themselves.

A cable-clamping device comprising a base and a clamping element is known from European Patent EP1257011; the clamping element is fixed to the base by means of at least one screw and a ratchet device, comprising a rib having a transversal toothing integrally formed with the clamping element on the opposite side with respect to the screw, and a recess formed in the base, parallelly to a seat, to receive the entire length of the rib, and having therein at least one elastically deformable tooth positioned so as to snapping mesh with the transversal toothing.

The cable-clamping devices of the above-described type are generally made by moulding starting from a thermoplastic synthetic plastic resin, so as to be electrically insulating. The material to be moulded, generally pre-heated, is firstly introduced into the cavity of an open, heated mould. The mould is thus closed with a male plug, a pressure is applied to force the material to come into contact with all of the parts of the mould, and the heat and the pressure are maintained for the necessary time. Since the cable-clamping devices of the described type normally present undercuts, their manufacturing process generally implies the use of sliding parts in the moulds, thus making both the moulding process and the manufacturing apparatus of said cable-clamping devices relatively complex.

DISCLOSURE OF INVENTION

It is therefore an object of the present invention to provide a cable-clamp device designed to eliminate the aforesaid drawbacks, which may be simply and cost-effectively manufactured by moulding starting from a thermoplastic synthetic plastic resin in a single operation by means of a mould and a male plug which do not necessarily have sliding parts, despite being provided with appropriate holes and seats for the cables and the clamping screw or screws.

According to the present invention, a cable-clamping device as defined in claim 1 is thus provided.

Specifically, the device comprises a base having a through-seat for accommodating at least one electrical cable, for example an electrical power cable of a household appliance; and a clamping element progressively insertable in the seat in a direction transversal to the seat and defined in use by an axis laying on a longitudinal symmetry plane of the clamping element, for clamping in use the cables against a bottom wall of the seat. The clamping element is delimited between a first and a second end thereof by a first and a second lateral flank essentially parallel to the longitudinal symmetry plane and by an upper face essentially perpendicular to the lateral flanks, the first and the second ends being provided with coupling means to the base comprising snapping retaining means made at the second end and an insertion seat for at least one removable tightening element.

According to an aspect of the invention, the insertion seat is defined by at least one first recess open on the first lateral flank and flush with said upper face, by at least one second recess open on the second lateral flank and obtained immediately adjacent to, and flush with, said first recess, and at least one slot made transversally through the first end, in a direction essentially perpendicular to the lateral flanks and on opposite side with respect to said first recess.

The transversal slot is made through said first end in a position immediately adjacent to and flush with the second recess, so that the first and second recesses and the slot seamlessly create the insertion seat, which is parallelly oriented in the direction of insertion of the clamping element in the through-seat of the base and is open towards the latter.

The transversal slot divides a terminal portion of the first end, arranged on a side opposite to said upper face, into two guiding side members of the clamping element, while the base is provided, at a first end of the through-seat for at least one electrical cable, with a pair of longitudinal guiding housings for the side members of the clamping element; specifically, the longitudinal housings are arranged parallelly to the direction of insertion of the clamping element in the seat of the base and the latter is further provided, between the longitudinal housings, with a fastening seat for the removable tighten element.

In this manner, the holes and the insertion seats for the screws the tightening of which may be needed in use may be made in the course of a simple and cost-effective moulding operation in a known manner, solely by using an appropriately shaped mould and male plug which do not require sliding elements. Specifically, the first and second recess and the slot present the open sides facing the same direction as the teeth (and the corresponding compartments) of a rack toothing belonging to the snapping retaining means.

Furthermore, the clamping element and the base are preferably integrally in one piece connected together by a deformable tongue, so that they can be moulded in a known manner, and then arranged in use with facing concavities.

BRIEF DESCRIPTION OF THE DRAWINGS

Further features and advantages of the present invention will be apparent from the following description of a preferred embodiment thereof, exclusively provided by way of non-limitative example, with reference to the accompanying drawings, in which.

BEST MODE FOR CARRYING OUT THE INVENTION

Figure 1:
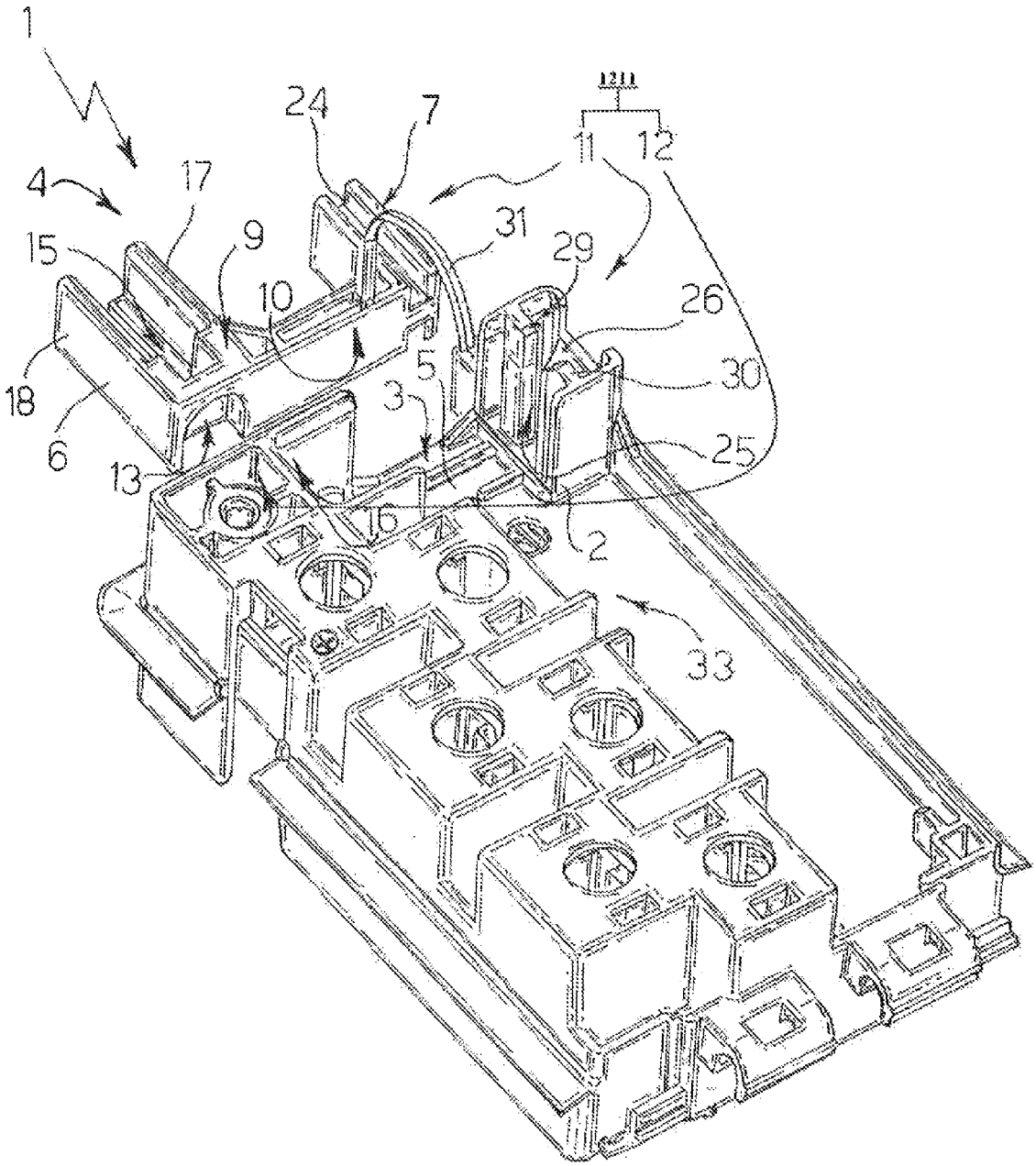
FIG. 1 shows an axonometric isometric view of the cable-clamping device according to the present invention, shown integrated with the body of a known terminal board.
Figure 2:
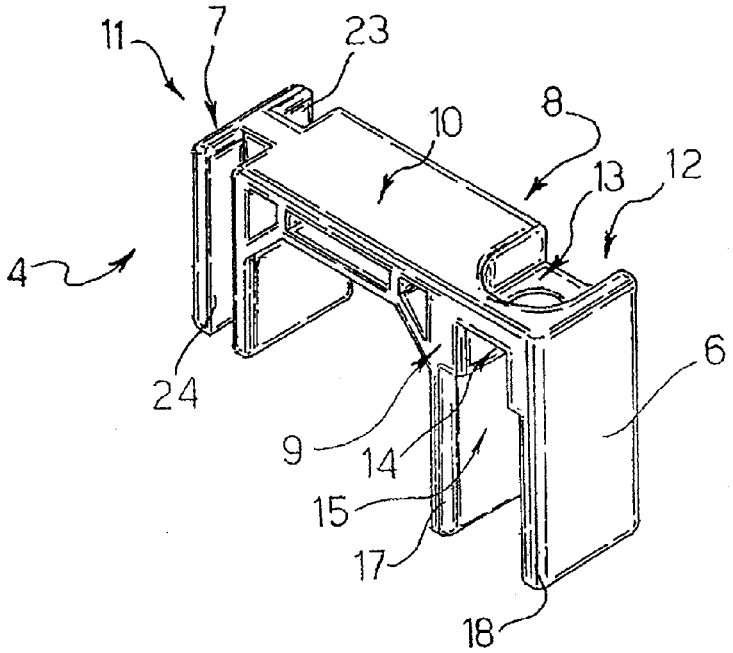
FIG. 2 shows an axonometric view of the clamping element belonging to the cable-clamping device according to the present invention.
Figure 3:
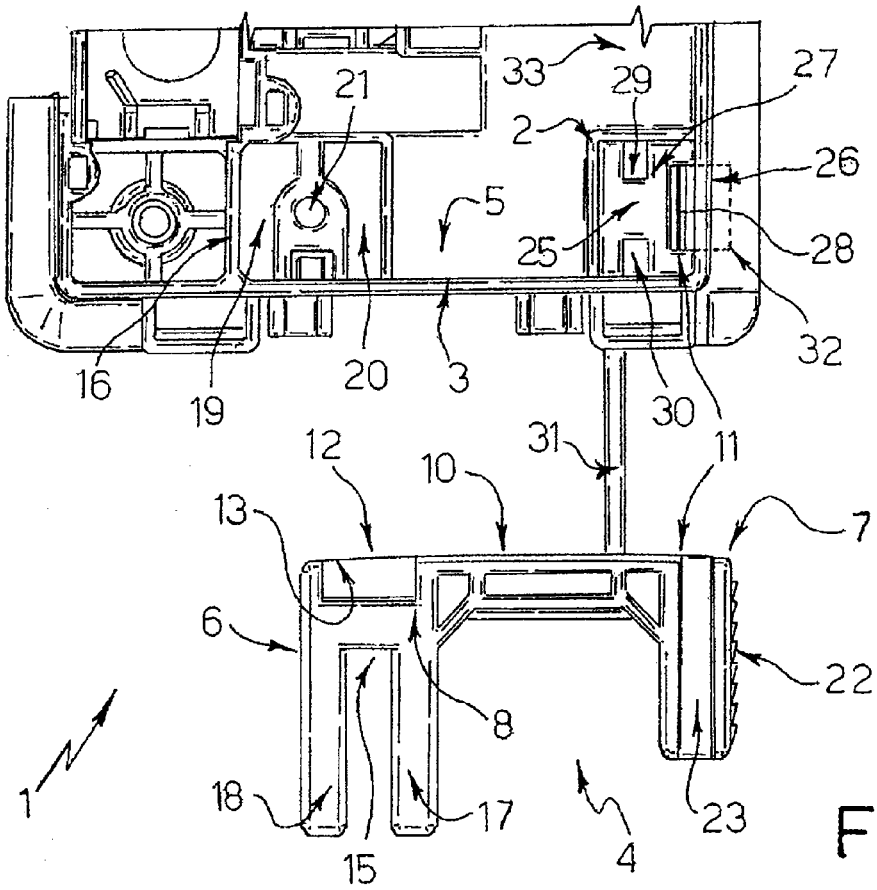
FIG. 3 shows a partial plan view of the cable-clamping device according to the present invention, shown integrated with the body of a known terminal board.

With reference to FIGS. 1 to 3, numeral 1 indicates a cable-clamping device, in particular for household appliances, comprising a base 2 presenting a through-seat 3 for accommodating at least one electrical cable, for example an electrical power cable of a household appliance (known and not shown for the sake of simplicity); and a clamping element 4 progressively insertable in seat 3 in a direction transversal to the seat and defined in use by an axis (A) (FIG. 3) laying on a longitudinal symmetry plane of clamping element 4 (FIG. 1), for clamping in use the cables against a bottom wall 5 of the seat.

Clamping element 4 (FIG. 1) is delimited between a first end 6 and a second end 7 thereof by a first lateral flank 8 and a second lateral flank 9, essentially parallel to the longitudinal symmetry plane and by an upper face 10 essentially perpendicular to lateral flanks 8,9; ends 6,7 are further provided with coupling means 1211 to base 2 comprising snapping retaining means 11 made at second end 7 and an insertion seat 12 for at least one removable tightening element (known and not shown for the sake of simplicity), for example a screw.

According to an aspect of the invention, insertion seat 12 (FIGS. 1 and 2) is defined by at least one first recess 13 open on first lateral flank 8 and flush with upper face 10, by at least one second recess 14 open on second lateral flank 9 and immediately adjacent to, and flush with, first recess 14, and at least one slot 15 made transversally through first end 6, in a direction essentially perpendicular to lateral flanks 8,9 and on the opposite side with respect to first recess 14.

Transversal slot 15 is made through first end 6 in a position immediately adjacent to and flush with second recess 14, so that first and second recesses 13,14 and slot 15 seamlessly create insertion seat 12, which is oriented parallelly to the direction of insertion A of clamping element 4 in seat 3 of base 2 and is open towards the latter.

Transversal slot 15 divides a terminal portion of first end 6, arranged on the opposite side of upper face 10, into two guiding side members 17,18 for clamping element 4.

Base 2 (FIG. 3) is provided, at a first end 16 of through-seat 3 for the mentioned at least one electrical cable, with a pair of longitudinal guiding housings 19,20 for side members 17 and 18 of clamping element 4. Longitudinal housings 19 and 20 are arranged parallelly to the direction of insertion A of clamping element 4 in seat 3 of base 2. The latter is further provided, between longitudinal housings 19 and 20, with a fastening seat 21 for said at least one removable tightening element, such as a screw.

Snapping retaining means 11 are adapted to secure clamping element 4 to base 2, so as to allow a selective adjustment of the distance between clamping element 4 and bottom wall 5 of through-seat 3; and such as to make the assembly of the screw in seat 21 only a security element.

Snapping retaining means 11 specifically comprise (FIG. 3) a rack toothing 22 oriented parallelly to the direction of insertion A of clamping element 4 in through-seat 3 of base 2 and made at second end 7 of clamping element 4, on the side opposite to first end 6. Second end 7 is further provided on each lateral flank 8,9 of clamping element 4 with a respective longitudinal groove 23, 24 oriented parallelly to the direction of insertion A of clamping element 4 in seat 3 of base 2.

Snapping retaining means 11 further comprise a recess 25 made on base 2 at a second end 26 of through-seat 3 for the above-mentioned at least one said electrical cable, adapted to receive in use through its lead-in opening 27 and essentially along direction of insertion (A) said second end 7 of clamping element 4.

Snapping retaining means 11 finally comprise at least one elastically deformable tooth 28 transversally and protrudingly arranged within recess 25 of base 2 so as to be adapted to snappingly mesh, in use, with rack toothing 22.

Recess 25 of the base is internally provided, on opposite sides of elastically deformable tooth 28, with a first and a second rib 29, 30, adapted to couple, in use, with grooves 23,24 of second end 7 of clamping element 4.

Clamping element 4 and base 2 are made by moulding of a synthetic plastic material, by means of a known moulding procedure, without the need of using moulds provided with mobile parts, despite being shaped so that the first may be inserted within the second to be reciprocally fastened by means of the removable tightening element and rack toothing 22.

Specifically, they may be moulded using appropriate mould and male plug which are drawn against each other along a direction transversal to clamping element 4 (i.e. perpendicularly to the longitudinal symmetry plane of the latter containing axis A), without resorting to mobile parts. This is because the teeth (and the corresponding spaces between the teeth) of rack toothing 22 are oriented, as described, perpendicularly to lateral flanks 8,9, like the open sides of recesses 13,14 and slot 15.

In order to allow the simultaneous moulding of base 2 and clamping element 4, maintaining the same joined also when seat 3 is not engaged, clamping element 4 and the base are integrally connected together (in known manner) by a deformable tongue 31.

Base 2 may be provided with snapping fastening means 32 to a support, by means of which it may be connected for example to the body of a terminal board 33 or directly to the carcass of a household appliance, so that device 1 is self-standing. Alternatively, base 2 may be integrally obtained in one piece with a terminal board 33, as integral part of the latter, thus device 1 is integrated in terminal board 33.

The invention claimed is:

1. A cable-clamping device for a household appliance, comprising:

a base having a through-seat for accommodating at least one electrical cable of the household appliance; and a clamping element progressively insertable in the seat in a first direction transversal to the seat and defined in use by an axis laying on a longitudinal symmetry plane of the clamping element, for clamping in use the cables against a bottom wall of the seat; the clamping element being delimited between a first and a second ends by a first and a second lateral flanks essentially parallel to the symmetry plane and by an upper face essentially parallel to the lateral flanks, the first and the second ends being provided with coupling means to the base comprising snapping retaining means made at the second end and an insertion seat for at least one removable tightening element, wherein the insertion seat is defined by at least one first recess open on the first lateral flank and flush with said upper face, by at least one second recess open on the second flank and immediately adjacent to, and flush with, said first recess, and at least one slot made transversally through the first end, in a second direction essentially perpendicular to the lateral flanks and on a side opposite to said first recess.

2. The device according to claim 1, wherein said slot is made through said first end in a position immediately adjacent to and flush with said second recess, so that said first and second recesses and said slot seamlessly create said insertion seat, which is oriented parallel to said first direction of insertion of the clamping element in the seat of the base and is open towards the base.

3. The device according to claim 1, wherein said slot divides a terminal portion of the first end, arranged on a side opposite to said upper face, into two guiding side members of the clamping element.

4. The device according to claim 3, wherein said base is provided, at a first end of said through-seat for said at least one electrical cable, with a pair of longitudinal guiding housings for said side members of the clamping element, said longitudinal housings being arranged parallelly to said first direction of insertion of the clamping element in the seat of the base; and the base being also provided, between said longitudinal housings, with a fastening seat for said at least one removable tightening element.

5. The device according to claim 1, wherein said snapping retaining means are adapted to secure said clamping element to said base, so as to allow a selective adjustment of a distance between said clamping element and said bottom wall of the through-seat.

6. The device according to claim 5, wherein said snapping retaining means comprise a rack toothing oriented parallelly to said first direction of insertion of the clamping element in the through-seat of the base and made at said second end of the clamping element, on a side opposite to said first end; and said second end being provided on each side flank of the clamping element with a respective longitudinal groove oriented parallelly to said first direction of insertion of the clamping element in the seat of the base.

7. The device according to claim 6, wherein said snapping retaining means further comprise a recess made on said base at a second end of said through-seat for said at least one said electrical cable, adapted to receive in use, through a lead-in opening thereof and essentially along said first direction of insertion, said second end of the clamping element; and at least one elastically deformable tooth transversally and protrudingly arranged within said recess of the base so as to be adapted to snappingly mesh, in use, with said rack toothing.

8. The device according to claim 7, wherein said recess of the base is internally provided, on the side opposite to said elastically deformable tooth with a first and a second ribs adapted to couple, in use, with said grooves of said second end of the clamping element.

9. The device according to claim 1, wherein said clamping element and said base have been made by moulding a synthetic plastic material without the need of using moulds provided with mobile parts while being shaped so as said clamping element is insertable within said base to be reciprocally fastened by said removable tightening element.

10. The device according to claim 1, wherein said clamping element and said base are reciprocally and integrally connected by a deformable tongue.

11. The device according to claim 1, wherein said base is provided with a snapping fastening means for coupling to a support.

12. A cable-clamping device according to claim 1, wherein said base is integral in one piece with a terminal board.

* * * * *